US010994957B2

(12) United States Patent
Chen et al.

(10) Patent No.: US 10,994,957 B2
(45) Date of Patent: May 4, 2021

(54) ROLLER STRUCTURE

(71) Applicant: TECO IMAGE SYSTEMS CO., LTD., Taipei (TW)

(72) Inventors: Ting-Chun Chen, Taipei (TW); Ming-Chieh Chung, Taipei (TW)

(73) Assignee: TECO IMAGE SYSTEMS CO., LTD., Taipei (TW)

( * ) Notice: Subject to any disclaimer, the term of this patent is extended or adjusted under 35 U.S.C. 154(b) by 238 days.

(21) Appl. No.: 16/209,754

(22) Filed: Dec. 4, 2018

(65) Prior Publication Data

US 2020/0156392 A1 May 21, 2020

(30) Foreign Application Priority Data

Nov. 16, 2018 (TW) ..... 107140691

(51) Int. Cl.
*B65H 5/06* (2006.01)
*B41J 13/076* (2006.01)
(Continued)

(52) U.S. Cl.
CPC ..... *B65H 5/062* (2013.01); *B41J 13/03* (2013.01); *B41J 13/076* (2013.01); *B65H 27/00* (2013.01); *B65H 2404/1341* (2013.01)

(58) Field of Classification Search
CPC ..... B65H 5/06; B65H 5/062; B65H 27/00; B65H 29/20; B65H 2401/231; B65H 2402/33; B65H 2402/34; B65H 2402/544; B65H 2404/134; B65H 2404/1341; B65H 2404/143; B65H 2404/1431;
(Continued)

(56) References Cited

U.S. PATENT DOCUMENTS 4,997,179 A * 3/1991 Mizutani ..... B41J 13/103 271/274
8,490,969 B2 * 7/2013 Sawamura ..... B65H 29/14 271/274
(Continued)

FOREIGN PATENT DOCUMENTS

CN 1451553 A 10/2003
CN 103707656 A 4/2014
(Continued)

*Primary Examiner* — Prasad V Gokhale
(74) *Attorney, Agent, or Firm* — Kirton McConkie; Evan R. Witt

(57) ABSTRACT

A roller structure is disclosed and includes at least one roller unit. The roller unit includes a base, an elastic portion, a supporting portion and a rotating wheel. The base is configured to detachably assemble the roller unit on an accommodation seat. The base includes a first lateral edge. The elastic portion is disposed on the base and connected with the first lateral edge. The elastic portion includes a bent section having an end extending and bent from the first lateral edge. The supporting portion is disposed on the elastic portion and connected to the other end of the bent section. The rotating wheel is pivotally connected to the supporting portion. When the rotating wheel is pressed by a driving wheel, the supporting portion is driven to compress the elastic portion to move the rotating wheel toward the base, and the rotating wheel is driven to rotate relative to the supporting portion.

11 Claims, 14 Drawing Sheets

(51) Int. Cl.
*B41J 13/03* (2006.01)
*B65H 27/00* (2006.01)

(58) Field of Classification Search
CPC ..... B65H 2404/144; B65H 2404/15; B65H 2404/152; B65H 2404/1521; B41J 13/076; B41J 13/03
USPC ..... 271/274
See application file for complete search history.

(56) References Cited

U.S. PATENT DOCUMENTS

| | | | | |
|---|---|---|---|---|
| 9,395,671 | B1 * | 7/2016 | Yano | B65H 29/14 |
| 10,011,445 | B2 * | 7/2018 | Suto | B65H 3/5223 |
| 2004/0251619 | A1 * | 12/2004 | Goto | B65H 5/062 271/274 |
| 2012/0153567 | A1 * | 6/2012 | Sawamura | B65H 29/14 271/272 |

FOREIGN PATENT DOCUMENTS

| | | | |
|---|---|---|---|
| JP | S6265860 | A | 3/1987 |
| JP | 1987097761 | U | 6/1987 |
| JP | 1995024840 | U | 5/1995 |
| JP | 2587513 | Y2 * | 12/1998 |
| JP | 2013069052 | A | 4/2013 |
| JP | 2015137169 | A | 7/2015 |
| JP | 2018034911 | A | 3/2018 |
| TW | M487210 | U | 10/2014 |
| TW | 201821293 | A | 6/2018 |

* cited by examiner

9

9

9

9a

ROLLER STRUCTURE

FIELD OF THE DISCLOSURE

The present disclosure relates to a roller structure, and more particularly to a roller structure having an elastic feature.

BACKGROUND OF THE DISCLOSURE

Nowadays, a multifunction machine or a multifunction printer (MFP) in the market commonly provides the paper transportation function by using a plurality of rubber driving wheels and a plurality of idler wheels to hold the paper. In the conventional paper transportation mechanism, each of the idler wheels includes a rotating shaft abutted against by an elastic piece, so that the elastic piece can push the idler wheel to tightly abut against the corresponding rubber driving wheel. When the rubber driving wheels rotate, the rubber driving wheels are in contact with the paper to drive the paper to move by the friction, and the idler wheels are driven to rotate due to the friction between the paper and the idler wheels so as to prevent the paper from rubbing against the idler wheels.

However, due to the limitation of the traditional manufacturing process, the current paper transportation mechanism in the market employs an external elastic piece to provide the elastic force to the idler wheel. The elastic piece is fixed on a frame body, and a position-limiting feature of the frame body clamps the elastic piece and the idle wheel to limit the position of the idler wheel. Namely, the position limitations of the idler wheels are achieved by the frame body. The integrated frame body drives the idler wheels to abut against the rubber driving wheels, respectively, during assembly, and it is easy to result that the frame is deformed and bent due to the pressing and engaging force. For example a central part of the frame body is deformed in a large amount. Consequently, the rubber driving wheels and the corresponding idler wheels are not firmly abutted against each other, and the paper cannot be effectively transported. It causes a problem of paper jam.

Therefore, there is a need of providing a roller structure having an elastic feature to address the above-mentioned issues.

SUMMARY OF THE DISCLOSURE

An object of the present disclosure is to provide a roller structure including at least one roller unit. The roller unit includes a roller shaft connected to a base through an elastic portion. The position of the roller shaft is adjustable according to the practical requirements. When the roller unit is assembled on a frame body, the roller shaft of the roller unit is not limited by the frame body and capable of accepting different pressing forces to adjust the position of the roller shaft relative to the frame body, thereby allowing the rotating wheel to rotate effectively and improving the operating efficiency.

Another object of the present disclosure is to provide a roller structure including a plurality of roller units detachably assembled with a frame body. Each roller unit includes a roller shaft and a base connected together through an elastic portion and integrated into one piece. The positions of the roller shafts of the roller units are adjustable relative to the frame body, respectively. When the roller structure is applied to for example a paper transportation mechanism and served as an idler system, the plurality of roller units can be driven by the pressing forces of the driving wheels of the power shaft, respectively. Since each roller unit can be pressed to adjust the position of the roller shaft relative to the frame body, the pressing forces of the driving wheels of the power shaft can be uniformly received to drive the roller units respectively, thereby achieving the purpose of stably transporting the paper. Therefore, the roller structure of the present disclosure can effectively avoid the problem that a portion of the roller wheels cannot be attached to the driving wheels of the power shaft due to the deformation of the frame body or the deformation of the power shaft, and the gap generates or the friction therebetween is insufficient. In addition, each roller unit is detachable and integrated in one piece, which is more conducive to simplifying the assembly process, saving costs, and improving operational efficiency.

In accordance with an aspect of the present disclosure, there is provided a roller structure. The roller structure includes at least one roller unit. The roller unit includes a base, an elastic portion, a supporting portion and a rotating wheel. The base is configured to detachably assemble the at least one roller unit on an accommodation seat. The base includes a first lateral edge. The elastic portion is disposed on the base and connected with the first lateral edge of the base. The elastic portion includes at least one bent section having an end extending and bent from the first lateral edge of the base and is configured to provide an elastic force. The supporting portion is disposed on the elastic portion and connected to the other end of the bent section. The rotating wheel is pivotally connected to the supporting portion. When the rotating wheel is pressed by a driving wheel, the supporting portion is driven to compress the elastic portion to move the supporting portion and the rotating wheel toward the base, and the rotating wheel is driven to rotate relative to the supporting portion.

In accordance with another aspect of the present disclosure, there is provided a roller structure including at least one frame body and a plurality of roller units. The frame body includes a plurality of accommodation seats disposed in a linear arrangement. The plurality of roller units are detachably disposed in the plurality of accommodation seats respectively and driven by at least one driving wheel. Each roller unit includes a base, an elastic portion, a supporting portion and a rotating wheel. The base is configured to detachably assemble the roller unit on the corresponding accommodation seat. The base includes a first lateral edge. The elastic portion is disposed on the base and connected with the first lateral edge of the base. The elastic portion includes at least one bent section having an end extending and bent from the first lateral edge of the base and configured to provide an elastic force. The supporting portion is disposed on the elastic portion and connected to the other end of the bent section. The rotating wheel is pivotally connected to the supporting portion. When the rotating wheel is pressed by the driving wheel, the supporting portion is driven to compress the elastic portion to move the supporting portion and the rotating wheel toward the base, and the rotating wheel is driven to rotate relative to the supporting portion.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
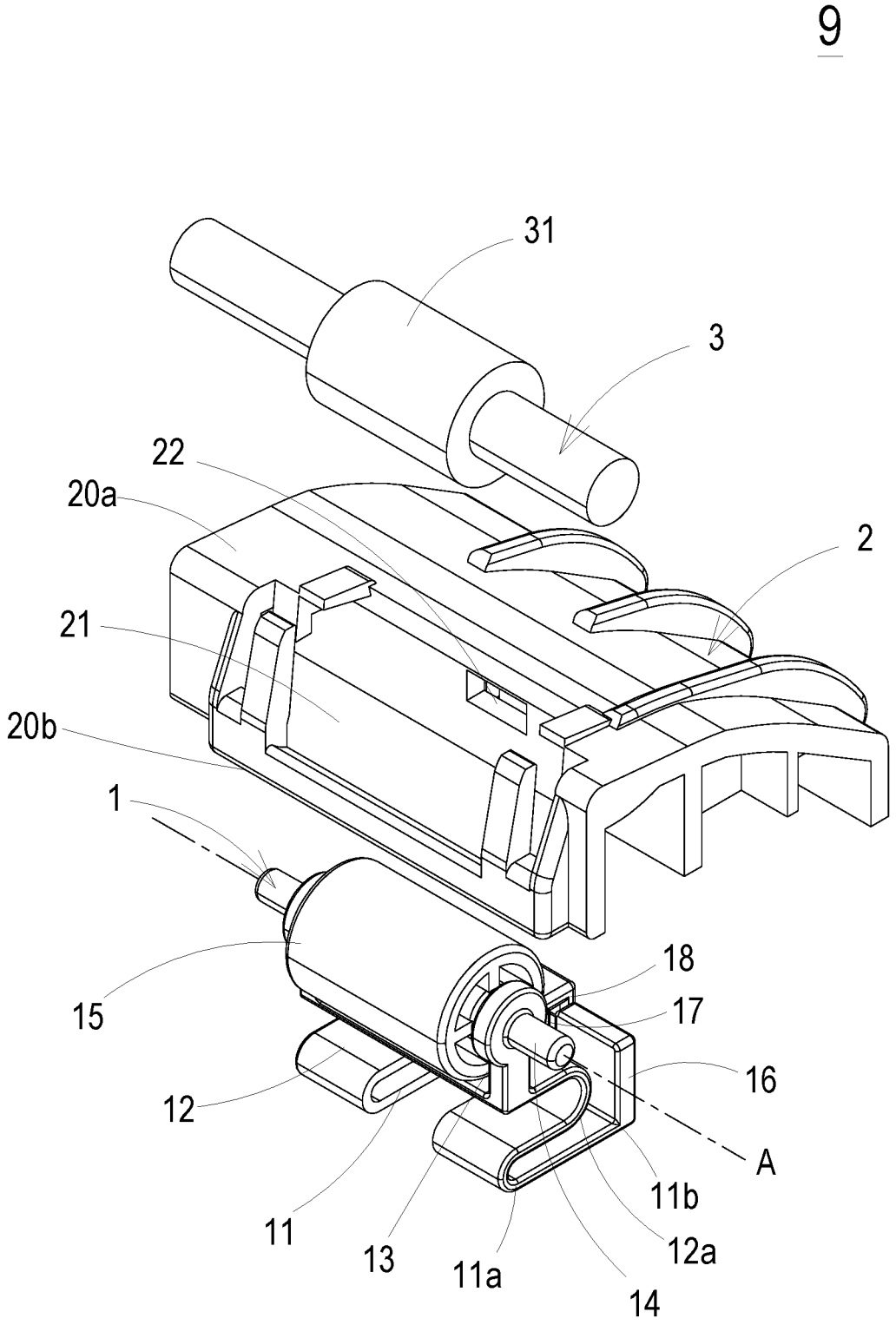
FIG. 1 is an exploded view illustrating a roller structure and a corresponding driving wheel of a power shaft according to a first embodiment of the present disclosure and taken from a top side.
Figure 2:
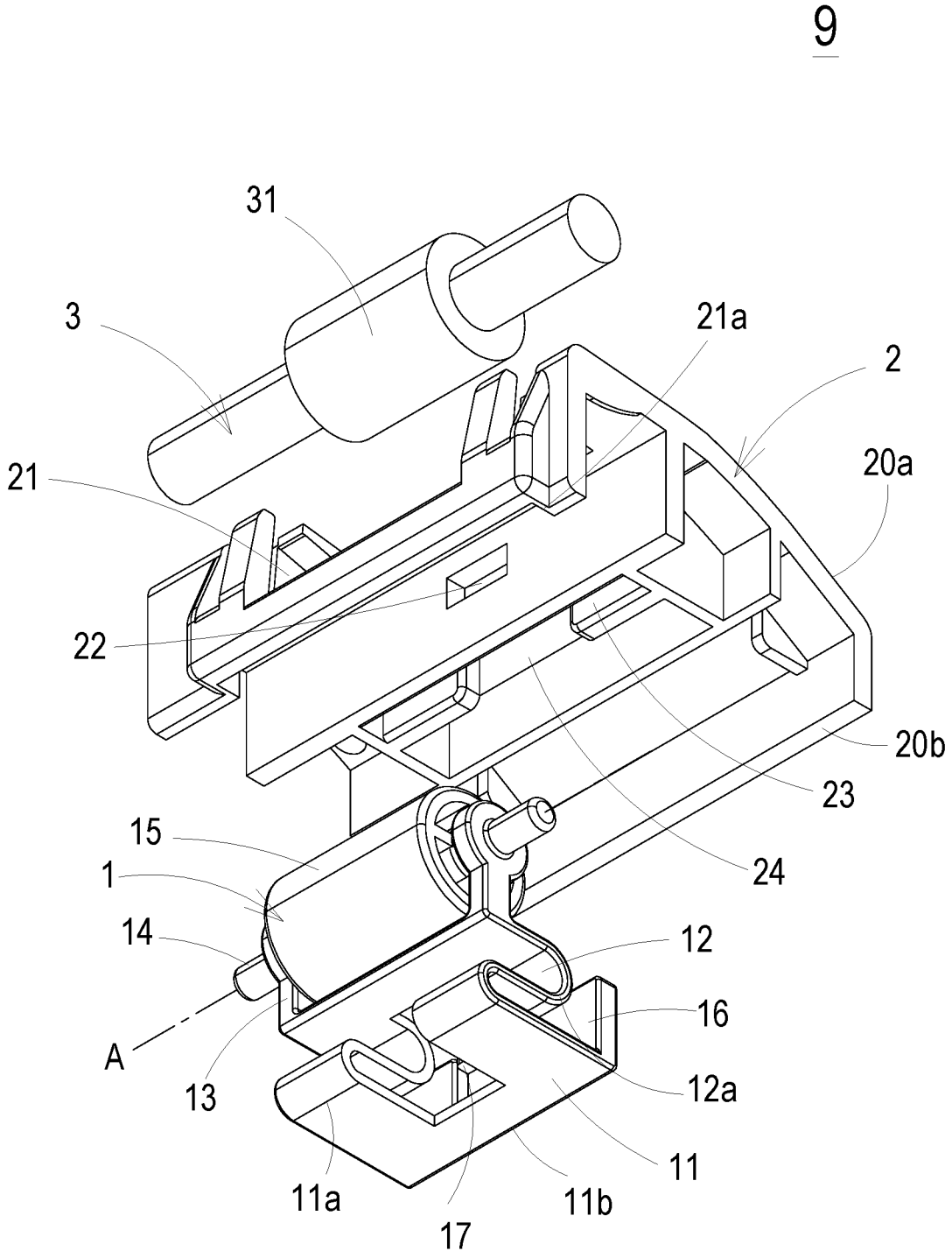
FIG. 2 is an exploded view illustrating the roller structure and the corresponding driving wheel of the power shaft according to the first embodiment of the present disclosure and taken from a bottom side.
Figure 3:
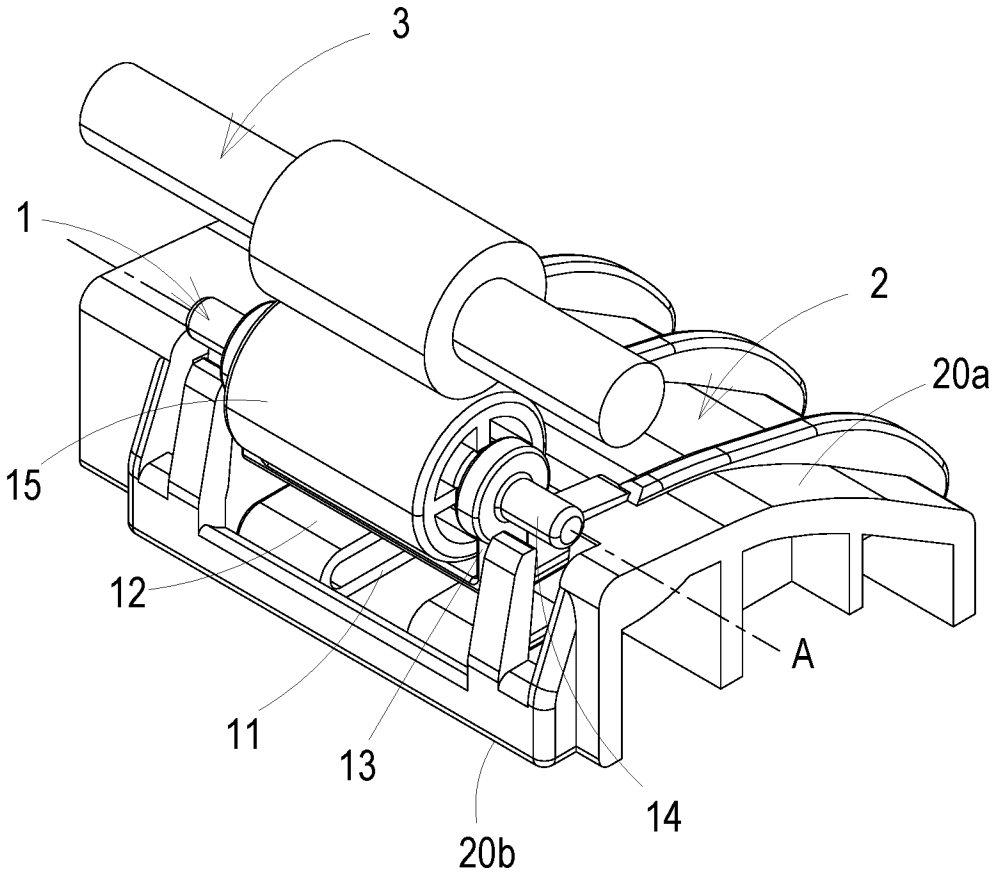
FIG. 3 is a schematic structural view illustrating the roller structure and the corresponding driving wheel of the power shaft according to the first embodiment of the present disclosure and taken from a top side.
Figure 4:
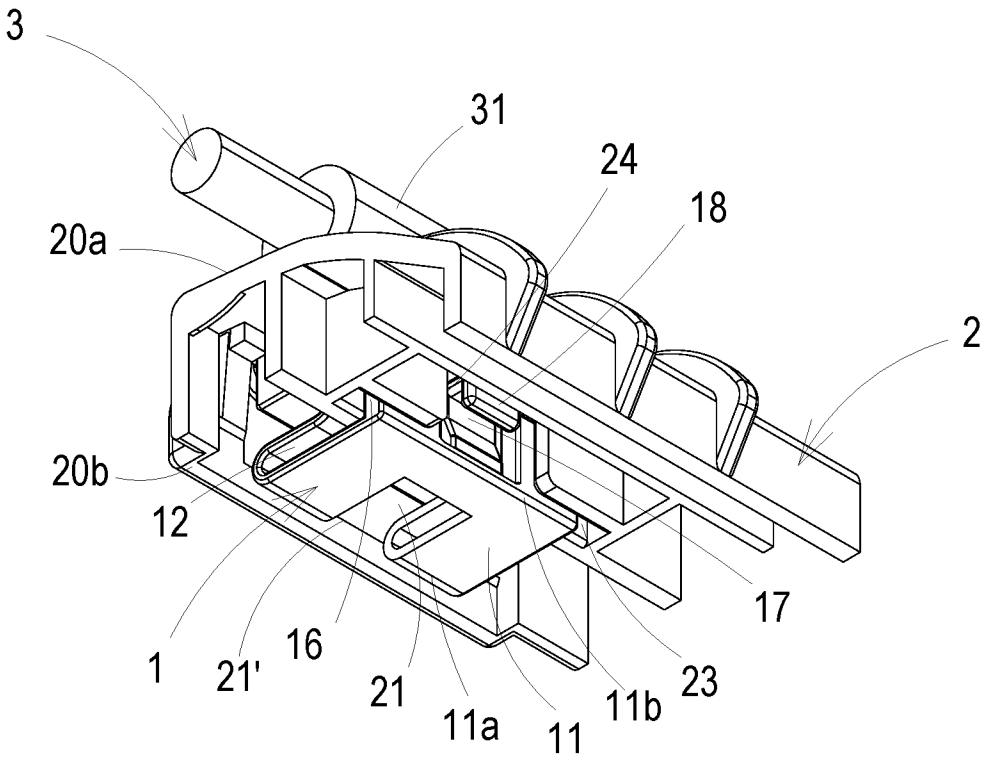
FIG. 4 is a schematic structural view illustrating the roller structure and the corresponding driving wheel of the power shaft according to the first embodiment of the present disclosure and taken from a bottom side.
Figure 5:
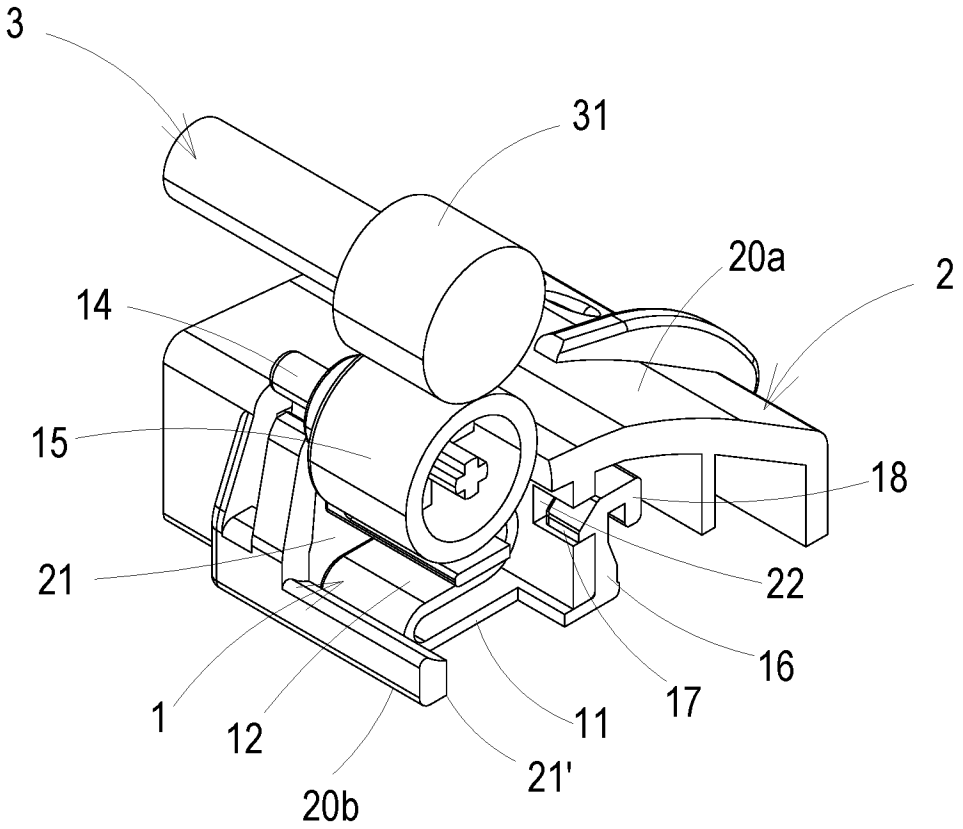
FIG. 5 is a schematic cross-sectional structural view illustrating the roller structure and the corresponding driving wheel of the power shaft according to the first embodiment of the present disclosure.
Figure 6:
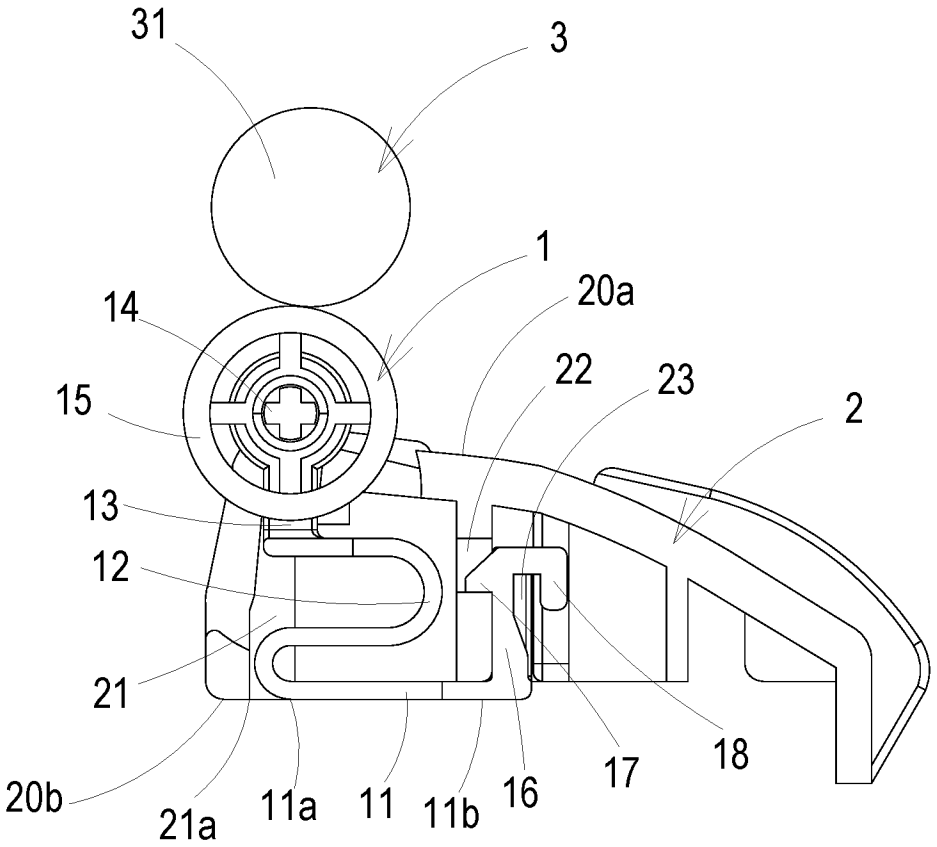
FIG. 6 is a lateral view of FIG. 5.

Please refer to FIGS. 1 to 6. FIGS. 1 and 2 are exploded views illustrating a roller structure and a corresponding driving wheel of a power shaft according to a first embodiment of the present disclosure and taken from a top side and a bottom side, respectively. FIGS. 3 and 4 are schematic structural views illustrating the roller structure and the corresponding driving wheel of the power shaft according to the first embodiment of the present disclosure and taken from a top side and a bottom side, respectively. FIG. 5 is a schematic cross-sectional structural view illustrating the roller structure and the corresponding driving wheel of the power shaft according to the first embodiment of the present disclosure. FIG. 6 is a lateral view of FIG. 5. In the embodiment, the roller structure is applied to for example a paper transportation mechanism and served as an idler. The roller structure includes at least one roller unit 1 and a frame body 2. The roller unit 1 is detachably disposed on the frame body 2. The frame body 2 includes a top surface 20*a*, a bottom surface 20*b* and at least one accommodation seat 21. The accommodation seat 21 is configured to accommodate the roller unit 1, and for example runs through the top surface 20*a* and the bottom surface 20*b*. It is not an essential feature to limit the present disclosure and described herein firstly. In the embodiment, the roller unit 1 includes a base 11, an elastic portion 12, a supporting portion 13 and a rotating wheel 15. The base 11 is configured to detachably assemble the at least one roller unit 1 on the accommodation seat 21. In the embodiment, the base 11 includes a first lateral edge 11*a* and a second lateral edge 11*b*, and the first lateral edge 11*a* and the second lateral edge 11*b* are opposite to each other. The elastic portion 12 is disposed on the base 11 and connected with the first lateral edge 11*a* of the base 11. The elastic portion 12 includes at least one bent section 12*a* having an end extending and bent from the first lateral edge 11*a* of the base 11 and is configured to provide an elastic force. In the embodiment, the at least one bent section 12*a* is bent as a C shape or an S shape. In addition, the supporting portion 13 is disposed on the elastic portion 12 and connected to the other end of the bent section 12*a*. The rotating wheel 15 includes a rotating shaft 14 and is pivotally connected to the supporting portion 13 through the rotating shaft 14. In the embodiment, the rotating shaft 14 is further exposed for example from the accommodation seat 21 or for example not in contact with the frame body 2. In the embodiment, the roller unit 1 is served as for example an idler, which is combined with a driving wheel 31 of a power shaft 3 to form a roller assembly 9. When the rotating wheel 15 is pressed by the driving wheel 31 of the power shaft 3, the rotating wheel 15 having the rotating shaft 14 is forced to drive the supporting portion 13 to compress the elastic portion 12 so that an elastic force is generated by the elastic portion 12 and the support portion 13 and the rotating shaft 14 of the rotating wheel 15 are moved toward the base 11. After the driving wheel 31 of the power shaft 3 is rotated, the rotating wheel 15 is further rotated about the axis A of the rotating shaft 14 with respect to the supporting portion 13 due to the friction force between the rotating wheel 15 and the driving wheel 31. In the embodiment, the base 11, the elastic portion 12, the supporting portion 13, the rotating shaft 14 and the rotating wheel 15 of the roller unit 11 can be manufactured in one piece by for example using an additive manufacturing technology (i.e. 3D printing technology), but the present disclosure is not limited thereto. It is noted that the rotating shaft 14 is still exposed from the accommodation seat 21 and not in contact with the frame body 2 when the rotating shaft 14 of the rotating wheel 15 is moved toward the base 11. Thus, the position of the rotating shaft 14 relative to the base 11 of the roller unit 1 is adjustable according to the practical requirements. Name, the position of the rotating shaft 14 relative to the frame body 2 is adjustable. Since the rotating shaft 14 of the roller unit 1 is not limited within the frame body 2, it allows to accept different pressing forces from the driving wheel 31 of the power shaft 3 to adjust the position of the rotating shaft 14 of the roller unit 1 and drive the rotating wheel 15 to rotate, thereby effectively improving the operating efficiency. Certainly, in other embodiments, the roller unit 1 can also be utilized directly instead of combining with the frame body 2. The distance of the rotating shaft 14 relative to the base 11 is adjusted according to the pressing of the driving wheel 31, but the present disclosure is not limited thereto. The detail actions of the roller unit 1 will be described as follows.

Figure 7:
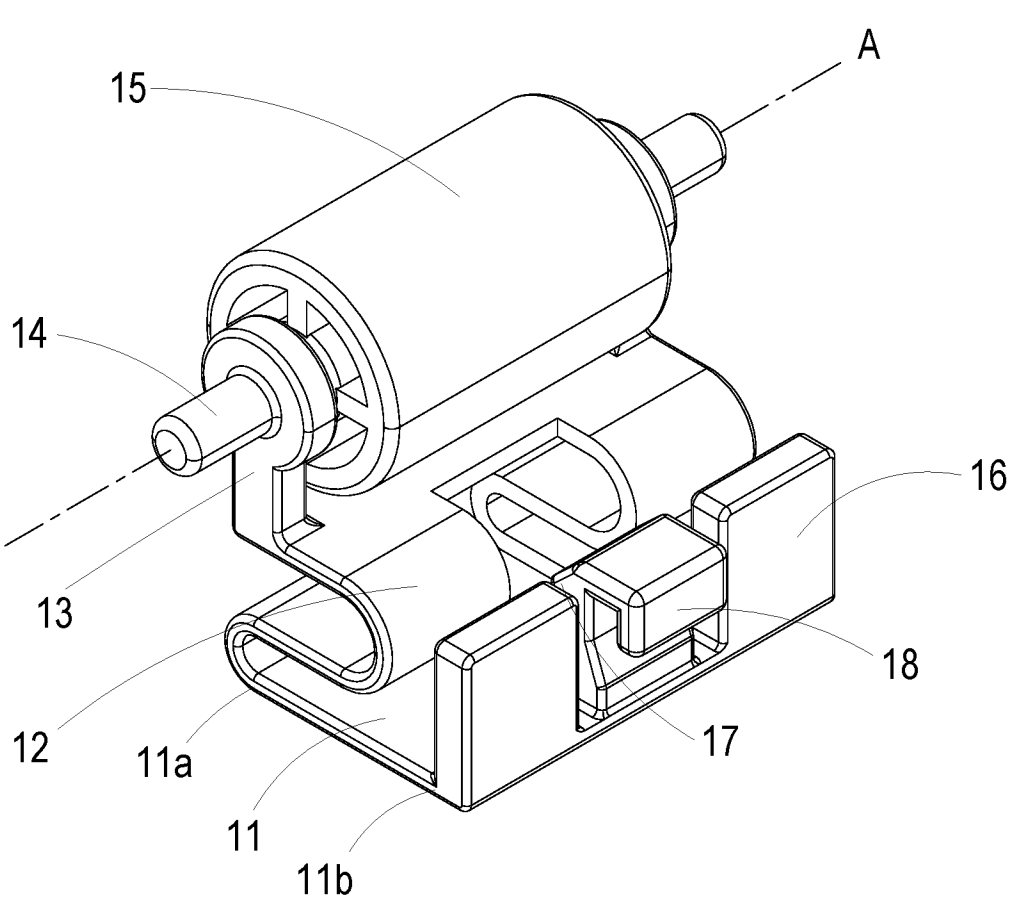
FIG. 7 is a schematic structural view illustrating the roller unit of the roller structure of the present disclosure.
Figure 8:
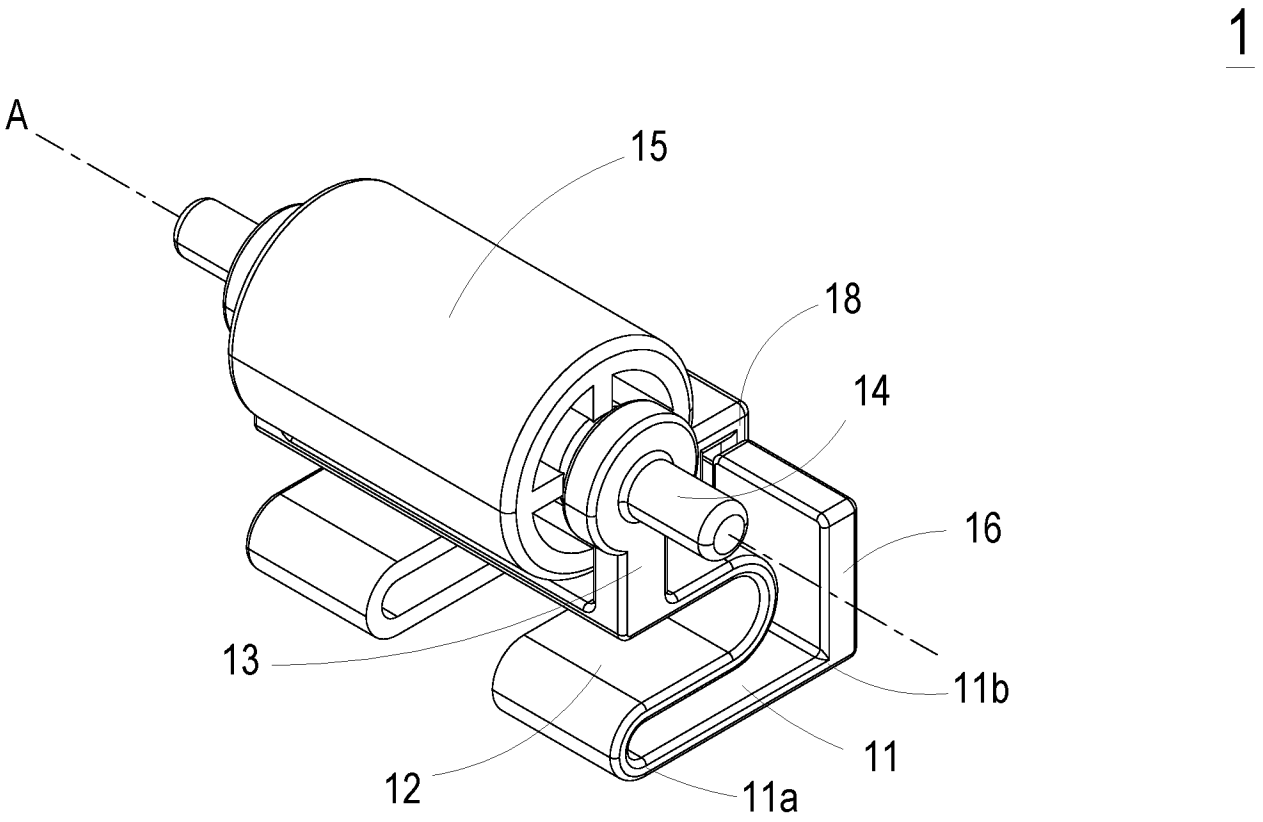
FIG. 8 is another schematic structural view illustrating the roller unit of the roller structure of the present disclosure taken from a different perspective.
Figure 9:
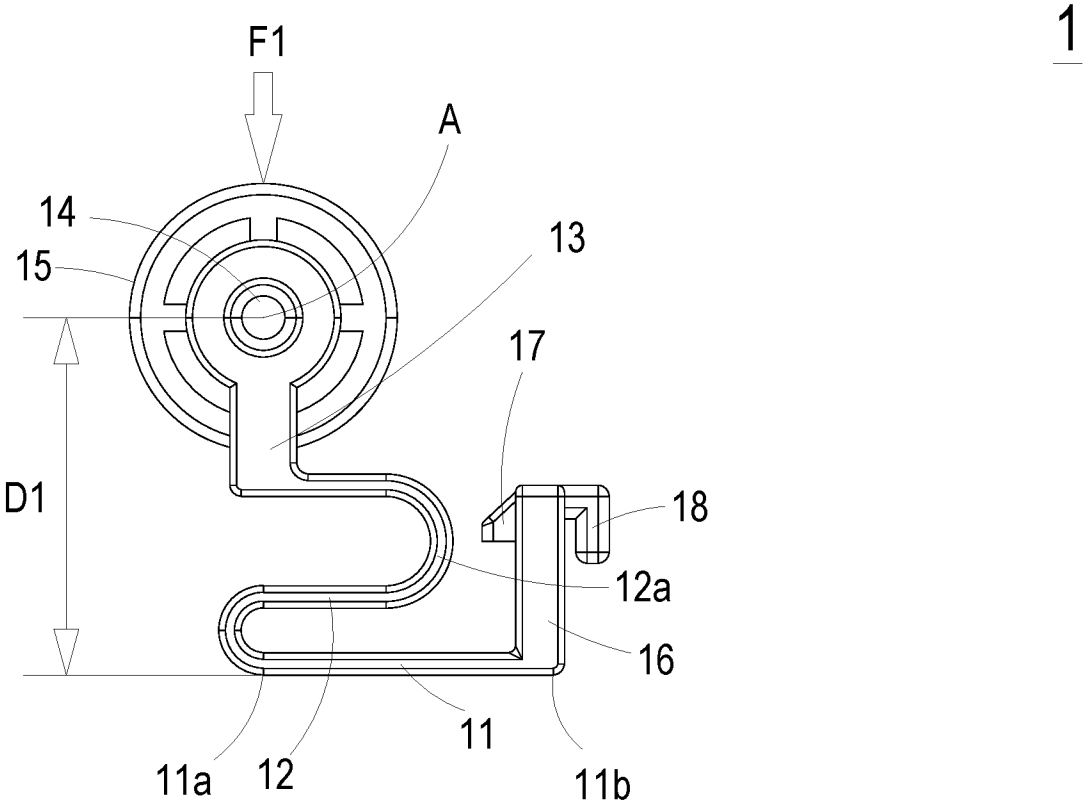
FIG. 9 is a schematic view illustrating the roller unit of the roller structure of the present disclosure in an operation status.
Figure 10:
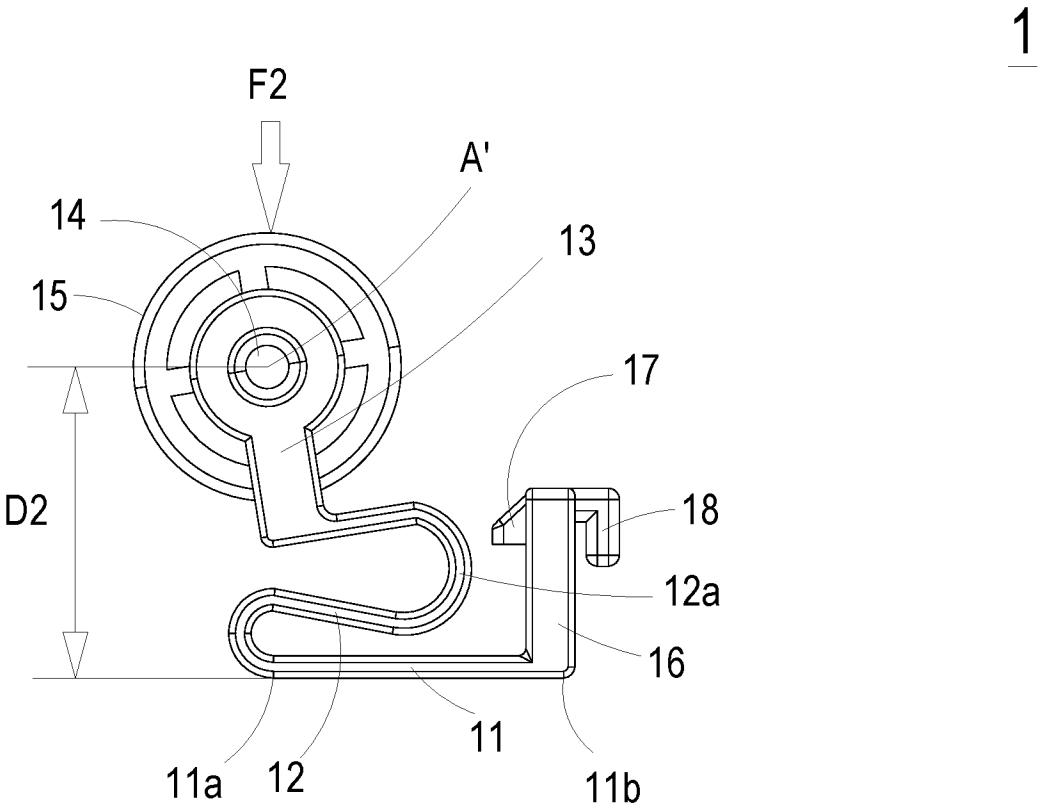
FIG. 10 is a schematic view illustrating the roller unit of the roller structure of the present disclosure in another operation status.

FIGS. 7 and 8 are schematic structural views illustrating the roller unit of the roller structure of the present disclosure. FIG. 9 is a schematic view illustrating the roller unit of the roller structure of the present disclosure in an operation status. FIG. 10 is a schematic view illustrating the roller unit of the roller structure of the present disclosure in another operation status. Please refer to FIGS. 1 to 10. In the embodiment, the integrated roller unit 1 includes the base 11, the elastic portion 12, the supporting portion 13, the rotating shaft 14 and the rotating wheel 15. When the roller unit 1 is served as an idler and driven by the pressing force from the driving wheel 31 of the power shaft 3, the positions of the supporting portion 13, the rotating shaft 14 and the rotating wheel 15 relative to the base 11 can be further adjusted due to the buffer effect of the elastic portion 12. For example, when the driving wheel 31 is displaced in a short distance to generate a smaller pressing force F1, the elastic portion 12 is slightly deformed to generate a smaller elastic force for withstanding the smaller pressing force F1. Consequently, the rotating shaft 14 of the rotating wheel 15 has the axis A maintained at a longer distance D1 from the bottom of the base 11. At this position, as shown in FIG. 9, the driving wheel 31 is rotated to drive the roller 15 to rotate. Alternatively, for example when the driving wheel 31 is displaced in a longer distance to generate a larger pressing force F2, the elastic portion 12 is obviously deformed to generate a larger elastic force for withstanding the larger pressing force F2. Consequently, the rotating shaft 14 of the rotating wheel 15 has the axis A' maintained at a shorter distance D2 from the bottom of the base 11. At this position, as shown in FIG. 10 the driving wheel 31 is rotated to drive the roller 15 to rotate. In other words, the integrated roller unit 1 of the present disclosure can accept different pressing forces from the driving wheel 31 due to different displacement, and adjust the position of the rotating wheel 15 and the rotating shaft 14 relative to the base 11. Namely, the position of the axis A or A' is adjustable, and it allows to drive the rotating wheel 15 to rotate at different positions. It benefits to effectively improve the operating efficiency.

Please refer to FIGS. 1 to 6 again. It should be noted that the integrated roller unit 1 of the present disclosure can be matched with various frame bodies 2 or directly constructed as a roller structure. In the embodiment, the numbers of the roller unit 1 and the frame body 2 are exemplified by one for each respectively in the following embodiments but not limited thereto. In order to detachably assemble the roller unit 1 with the frame body 2, the frame body 2 includes an accommodation seat 21 for example running through the top surface 20*a* and the bottom surface 20*b*. In the embodiment, the accommodation seat 21 includes an installation window 21' disposed on the bottom surface 20*b* of the frame body 2. Thus, it allows the roller unit 1 to run through the installation windows 21' from bottom to top and detachably disposed in the accommodation seat 21. Moreover, the roller unit 1 further includes a fixing portion 16 connected with the second lateral edge 11*b* of the base 11. The frame body 2 includes a fixing recess 23 disposed adjacent to an edge of the accommodation seat 21. The fixing portion 16 is corresponding to the fixing recess 23. When the roller unit 1 is accommodated in the accommodation seat 21, the fixing portion 16 and the fixing recess 23 are engaged with each other to fasten the roller unit 1 on the accommodation seat 21 of the frame body 2. Moreover, in the embodiment, the fixing portion 16 further includes a first engaging element 17, for example a protrusion, disposed on an edge of the fixing portion 16 and extended from the edge of the fixing portion 16 toward the base 11. Corresponding to the first engaging element 17, the accommodation seat 21 of the frame body 2 further includes a second engaging element 22, for example an opening, in communication between the accommodation seat 21 and the fixing recess 23. When the roller unit 1 is accommodated in the accommodation seat 21 and the fixing portion 16 is engaged with the fixing recess 23, the first engaging element 17 and the second engaging element 22 are engaged with each other, so as to fasten the roller unit 1 on the frame body 2 firmly. In addition, the fixing portion 16 includes a third engaging element 18, for example a protrusion, opposite to the first engaging element 17, extended from the edge of the fixing portion 16 and parted from the base 11. The frame body 2 includes a fourth engaging element 24, for example a slot opening, opposite to the second engaging element 22, disposed on a lateral wall of the fixing recess 23 and parted from the accommodation seat 21. When the roller unit 1 is accommodated in the accommodation seat 21 and the fixing portion 16 is engaged with the fixing recess 23, the third engaging element 18 and the fourth engaging element 24 are engaged with each other, so as to fasten the roller unit 1 on the frame body 2 firmly. Certainly, the types, the number, and the arrangement of the first engaging element 17, the second engaging element 22, the third engaging element 18 and the fourth engaging element 24 are adjustable according to practical requirements, and the present disclosure is not limited thereto. It is not redundantly described here.

Figure 11:
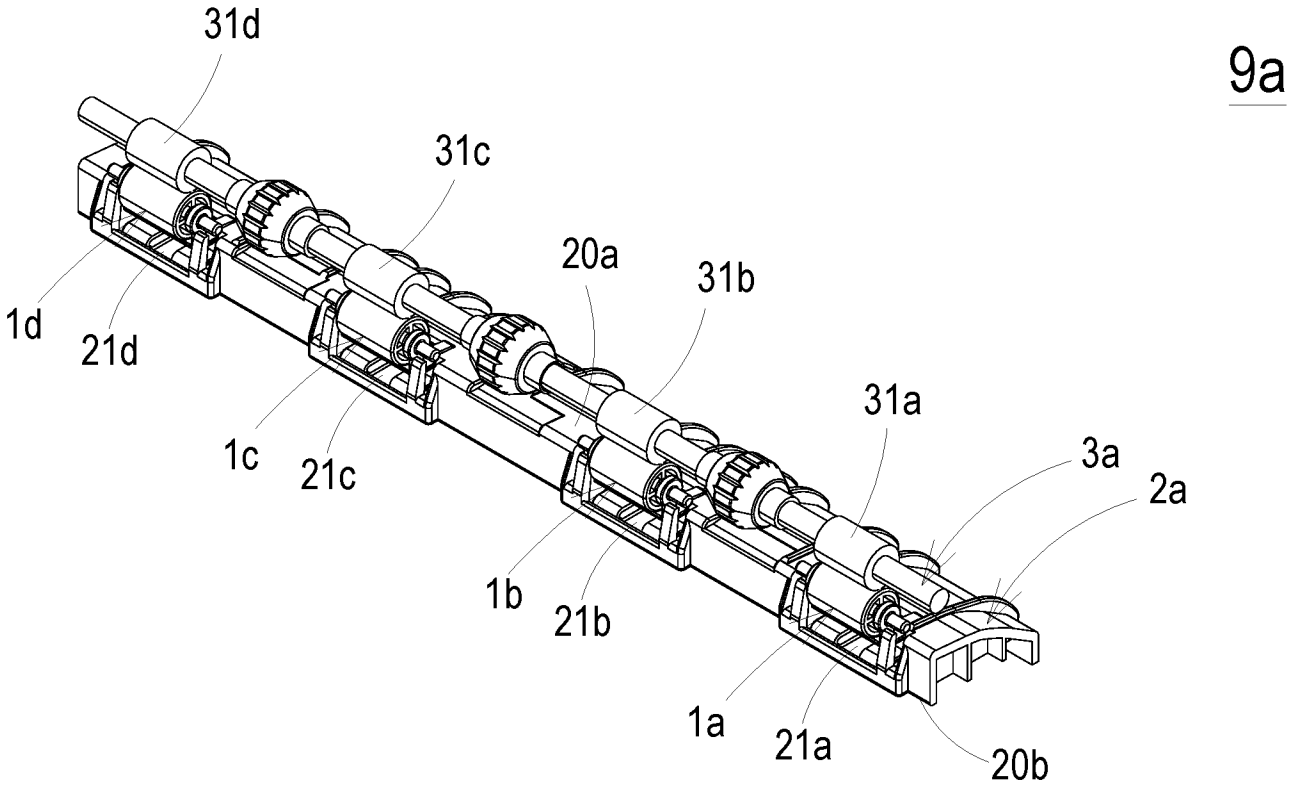
FIG. 11 is a schematic structural view illustrating a roller structure and plural corresponding driving wheels of a power shaft according to a second embodiment of the present disclosure and taken from a top side.
Figure 12:
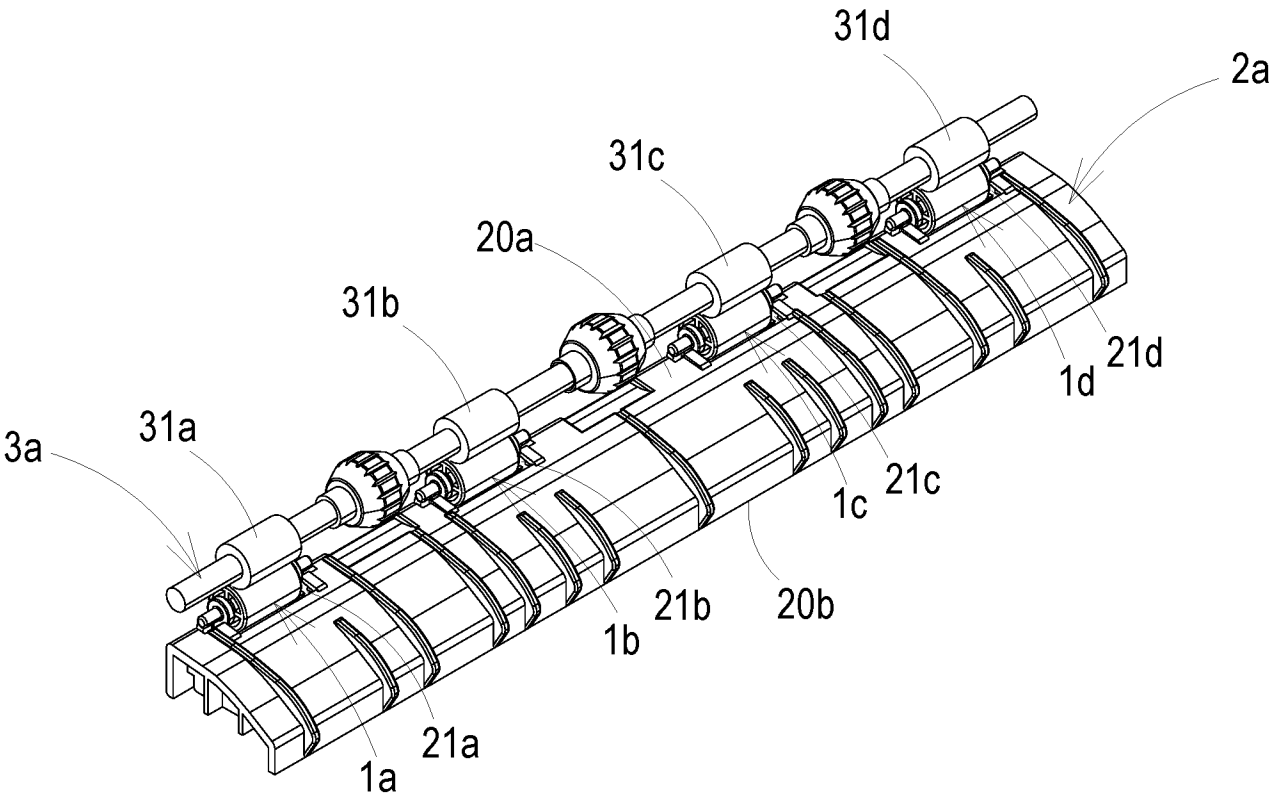
FIG. 12 is a schematic structural view illustrating the roller structure and the corresponding driving wheels of the power shaft according to the second embodiment of the present disclosure.
Figure 13:
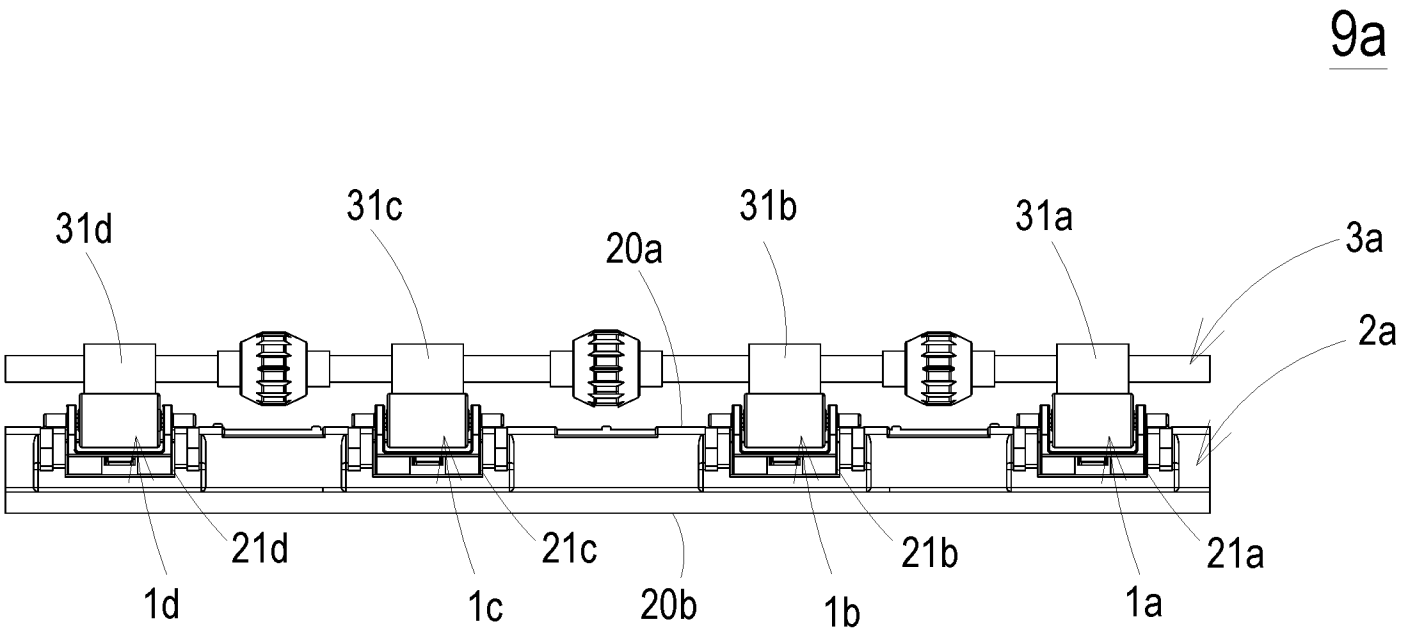
FIG. 13 is a front view illustrating the roller structure and the corresponding driving wheels of the power shaft according to the second embodiment of the present disclosure.
Figure 14:
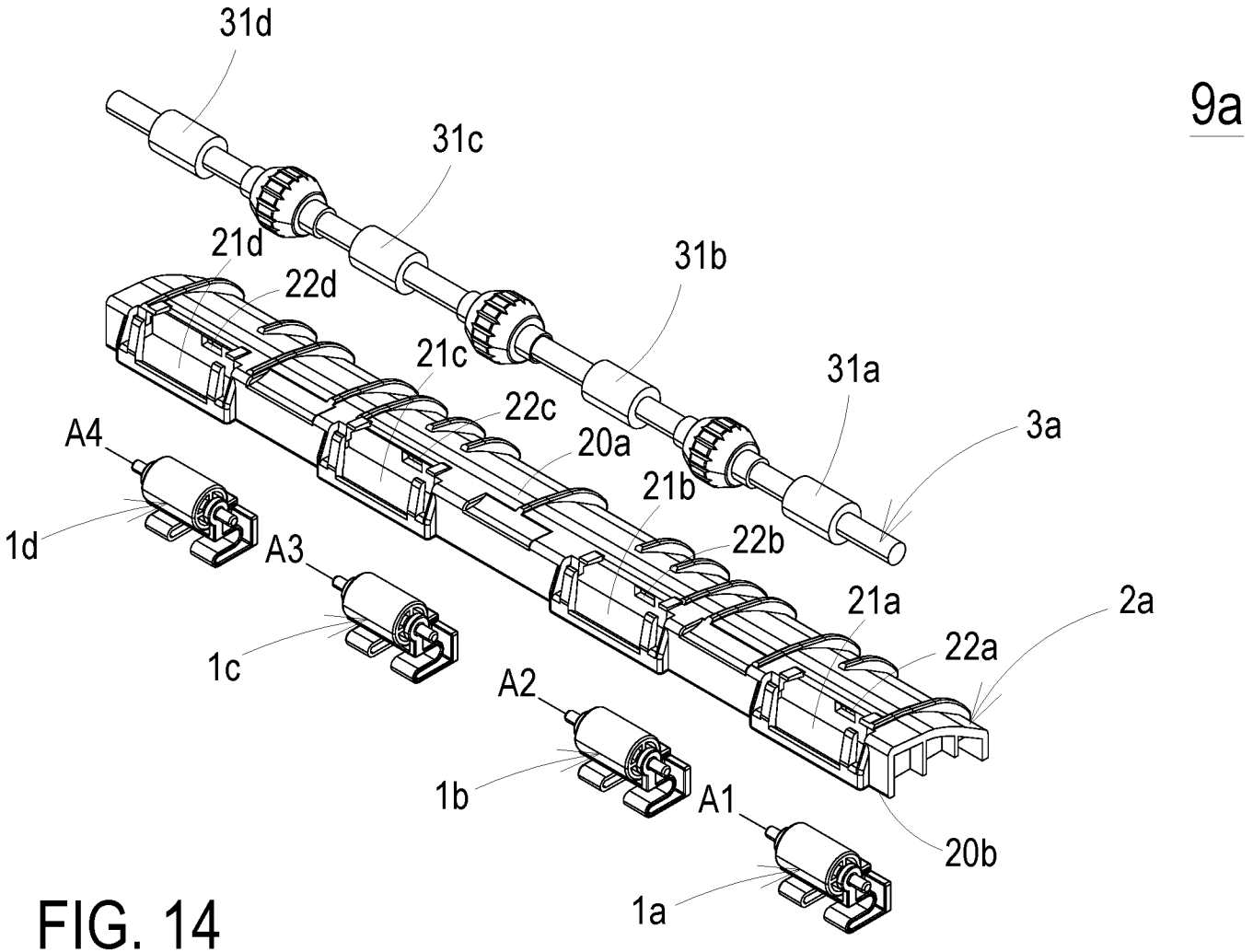
FIG. 14 is an exploded view illustrating the roller structure and the corresponding driving wheels of the power shaft according to the second embodiment of the present disclosure.

FIGS. 11 and 12 are schematic structural views illustrating a roller structure and plural corresponding driving wheels of a power shaft according to a second embodiment of the present disclosure. FIG. 13 is a front view illustrating the roller structure and the corresponding driving wheels of the power shaft according to the second embodiment of the present disclosure. FIG. 14 is an exploded view illustrating the roller structure and the corresponding driving wheels of the power shaft according to the second embodiment of the present disclosure. In the embodiment, the structures, elements and functions of the roller assembly 9*a* are similar to those of the roller assembly 9 in FIGS. 1 to 6, and are not redundantly described herein. In the embodiment, the roller assembly 9*a* includes for example a power shaft 3*a* to provide the driving force. The roller structure includes at least one frame body 2*a* and a plurality of roller units 1*a*, 1*b*, 1*c* and 1*d*. The at least one frame body 2*a* includes a plurality of accommodation seats 21*a*, 21*b*, 21*c* and 21*d* disposed on the at least one frame body 2*a* and arranged for example in a linear arrangement. In the embodiment, the plurality of roller units 1*a*, 1*b*, 1*c* and 1*d* have the same structures, which are detachably disposed in the plurality of accommodation seats 21*a*, 21*b*, 21*c* and 21*d*, respectively, and driven by the corresponding driving wheels 31*a*, 31*b*, 31*c* and 31*d* of the power shaft 3*a*. It is noted that the structures, elements and functions of the roller units 1*a*, 1*b*, 1*c* and 1*d* are similar to those of the roller unit 1 of the foregoing embodiment in FIGS. 1 to 6, and are not redundantly described herein. When the roller units 1*a*, 1*b*, 1*c* and 1*d* are disposed in the accommodation seats 21*a*, 21*b*, 21*c* and 21*d*, respectively, the roller units 1*a*, 1*b*, 1*c* and 1*d* are configured to form different axes A1, A2, A3 and A4 formed on the top surface 20*a* of the frame body 2*a*, respectively. Since all of the roller units 1*a*, 1*b*, 1*c* and 1*d* have an integrated and independent structure, respectively, the roller units 1*a*, 1*b*, 1*c* and 1*d* are capable of adjusting the positions of axes A1, A2, A3 and A4 in response to the pressing of the driving wheels 31*a*, 31*b*, 31*c* and 31*d*, respectively. For example, the roller structure of the present disclosure is applied to a paper transportation mechanism and served as an idler system. In case that the driving wheels 31*a*, 31*b*, 31*c* and 31*d* of the power shaft 3*a* fail to be arranged in the same plane due to manufacturing tolerances or long-term deformation of the power shaft 3*a*, when the power shaft 3*a* drives the driving wheels 31*a*, 31*b*, 31*c* and 31*d* to rotate and press the roller units 1*a*, 1*b*, 1*c* and 1*d*, respectively, the positions of the axes A1, A2, A3 and A4 of the roller units 1*a*, 1*b*, 1*c* and 1*d* are adjustable, respectively. Consequently, the pressed roller units 1*a*, 1*b*, 1*c* and 1*d* are sufficiently attached to the corresponding driving wheels 31*a*, 31*b*, 31*c* and 31*d* and capable of accepting the pressing forces from the corresponding driving wheels 31*a*, 31*b*, 31*c* and 31*d* of the power shaft 3*a* uniformly for driving. Thus, the purpose of stably transporting the paper is achieved, and it also avoids that a part of roller units 1*a*, 1*b*, 1*c* and 1*d* cannot be attached to the corresponding driving wheels 31*a*, 31*b*, 31*c* and 31*d* to generate a gap or a problem of insufficient friction due to the deformation of the power shaft 3*a*. Alternatively, in case that the plurality of accommodation seats 21*a*, 21*b*, 21*c* and 21*d* fail to be arranged in the same plane due to manufacturing tolerances or long-term deformation of the frame body 2*a*, and the uncovered axes A1, A2, A3 and A4 of the roller units 1*a*, 1*b*, 1*c* and 1*d* have different heights relative to the top surface 20*a* of the frame body 2*a* when the roller units 1*a*, 1*b*, 1*c* and 1*d* are disposed in the plurality of corresponding accommodation seats 21*a*, 21*b*, 21*c* and 21*d*. When the power shaft 3*a* drives the driving wheels 31*a*, 31*b*, 31*c* and 31*d* to rotate and press the roller units 1*a*, 1*b*, 1*c* and 1*d*, respectively, the positions of the axes A1, A2, A3 and A4 of the roller units 1*a*, 1*b*, 1*c* and 1*d* can be adjusted respectively and attached sufficiently to the corresponding driving wheels 31*a*, 31*b*, 31*c* and 31*d*. Consequently, the roller units 1*a*, 1*b*, 1*c* and 1*d* can accept the pressing forces of the corresponding driving wheels 31*a*, 31*b*, 31*c* and 31*d* of the power shaft 3*a* for driving uniformly. Thus, the purpose of stably transporting the paper is achieved, and it also avoids that a part of roller units 1*a*, 1*b*, 1*c* and 1*d* cannot be attached to the corresponding driving wheels 31*a*, 31*b*, 31*c* and 31*d* to generate a gap or a problem of insufficient friction due to the deformation of the frame body 2*a*.

In addition, it is noted that, in the embodiment, each roller unit 1 is detachable and integrated in one piece, but not redundantly described here. After the plurality of roller units 1*a*, 1*b*, 1*c* and 1*d* are respectively disposed in the plurality of accommodation seats 21*a*, 21*b*, 21*c* and 21*d* of the frame body 2*a*, the positions of the axes A1, A2, A3 and A4 of the roller units 1*a*, 1*b*, 1*c* and 1*d* can be independently adjusted in response to the pressing of the driving wheels 31*a*, 31*b*, 31*c*, and 31*d*, respectively. When any one of the plurality of roller units 1*a*, 1*b*, 1*c* and 1*d* is out of order, the replacement can be easily completed. Thus, the cost is reduced and the application performance of the roller structure is improved. Certainly, the manner in which the roller units 1*a*, 1*b*, 1*c* and 1*d* are disposed in the accommodation seats 21*a*, 21*b*, 21*c* and 21*d* of the frame body 2*a* is not an essential feature to limit the present disclosure. Any method of fastening the roller units 1*a*, 1*b*, 1*c* and 1*d* through the bases 11 and supporting the axes A1, A2, A3 and A4 through the elastic portions 12 to expose the axes A1, A2, A3 and A4 from the accommodation seats 21*a*, 21*b*, 21*c* and 21*d* is applicable to the present disclosure. The present disclosure is not limited thereto and not redundantly described herein.

In summary, the present disclosure provides a roller structure including at least one roller unit. The roller unit includes a roller shaft connected to the base through an elastic portion. The position of the roller shaft is adjustable according to the practical requirements. When the roller unit is assembled on a frame body, the roller shaft of the roller unit is not limited by the frame body and the roller shaft of the roller unit is capable of accepting different pressing forces to adjust the position of the roller shaft relative to the frame body, thereby driving the roller wheel to rotate effectively and improving the operating efficiency. Alternatively, the roller structure includes a plurality of roller units detachably assembled with a frame body. Each roller unit includes a roller shaft and a base connected together through an elastic portion and integrated into one piece. The positions of the roller shafts of the roller units are adjustable relative to the frame body, respectively. When the roller structure is applied to for example a paper transportation mechanism and served as an idler system, the plurality of roller units can be driven by the pressing forces of the driving wheels of the power shaft, respectively. Since each roller unit can be pressed to adjust the position of the roller shaft relative to the frame body, the pressing forces of the driving wheels of the power shaft can be uniformly received to drive the roller units respectively, thereby achieving the purpose of stably transporting the paper. Therefore, the roller structure of the present disclosure can effectively avoid the problem that a portion of the roller wheels cannot be attached to the corresponding driving wheels of the power shaft due to the deformation of the frame body or the deformation of the power shaft, and the gap generates or the friction therebetween is insufficient. In addition, each roller unit is detachable and integrated in one piece, which is more conducive to simplifying the assembly process, saving costs, and improving operational efficiency.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A roller structure comprising:

at least one roller unit comprising:

a base configured to detachably assemble the at least one roller unit on an accommodation seat, wherein the base comprises a first lateral edge and a second lateral edge, wherein the second lateral edge is opposite to the first lateral edge;

an elastic portion disposed on the base and connected with the first lateral edge of the base, wherein the elastic portion comprises at least one bent section having an end extending and bent from the first lateral edge of the base and configured to provide an elastic force;

a supporting portion disposed on the elastic portion and connected to an opposite end of the bent section;

a rotating wheel pivotally connected to the supporting portion, wherein when the rotating wheel is pressed by a driving wheel, the supporting portion is driven to compress the elastic portion to move the supporting portion and the rotating wheel toward the base, and the rotating wheel is driven to rotate relative to the supporting portion; and a fixing portion connected with the second lateral edge of the base and configured to engage with a fixing recess disposed adjacent to the accommodation seat, so as to fasten the roller unit on the accommodation seat, wherein the fixing portion comprises a first engaging element and the accommodation seat and corresponding to the first engaging element, wherein when the fixing portion and the fixing access are engaged with each other, the first engaging element and the second engaging element are engaged with each other, wherein the first engaging element is a protrusion extended from an edge of the fixing portion toward the base, and the second engaging element is an opening in communication between the accommodation seat and the fixing access.

2. The roller structure according to claim 1, wherein the at least one bent section is bent as a C shape or an S shape.

3. The roller structure according to claim 1, wherein the fixing portion comprises a third engaging element and the fixing recess comprises a fourth engaging element, and the third engaging element and the fourth engaging element are matched with each other, wherein when the fixing portion and the fixing recess are engaged with each other, the third engaging element and the fourth engaging element are engaged with each other.

4. The roller structure according to claim 3, wherein the third engaging element is a protrusion extended from an edge of the fixing portion and parted from the base, and the fourth engaging element is a slot opening disposed on a lateral wall of the fixing recess.

5. The roller structure according to claim 1, wherein the rotating wheel comprises a rotating shaft pivotally connected to the supporting portion and exposed from the accommodation seat.

6. A roller structure comprising:

at least one frame body having a plurality of accommodation seats and a fixing recess, wherein the plurality of accommodation seats are disposed in a linear arrangement, wherein the fixing recess is disposed adjacent to the accommodation seat; and a plurality of roller units detachably disposed in the plurality of accommodation seats respectively and driven by at least one driving wheel, wherein each roller unit comprises:

a base configured to detachably assemble the roller unit on the corresponding accommodation seat, wherein the base comprises a first lateral edge and a second lateral edge, wherein the second lateral edge is opposite to the first lateral edge;

an elastic portion disposed on the base and connected with the first lateral edge of the base, wherein the elastic portion comprises at least one bent section having an end extending and bent from the first lateral edge of the base and configured to provide an elastic force;

a supporting portion disposed on the elastic portion and connected to an opposite end of the bent section;

a rotating wheel pivotally connected to the supporting portion, wherein when the rotating wheel is pressed by the driving wheel, the supporting portion is driven to compress the elastic portion to move the supporting portion and the rotating wheel toward the base, and the rotating wheel is driven to rotate relative to the supporting portion; and a fixing portion connected with the second lateral edge of the base and configured to engage with a fixing recess, so as to fasten the roller unit on the corresponding accommodation seat, wherein the fixing portion comprises a first engaging element and the accommodation seat comprises a second engaging element disposed between the fixing recess and the accommodation seat and corresponding to the first engaging element, wherein when the fixing portion and the fixing recess are engaged with each other, the first engaging element and the second engaging element are engaged with each other, wherein the first engaging element is a protrusion extended from an edge of the fixing portion toward the base, and the second engaging element is an opening in communication between the accommodation seat and the fixing recess.

7. The roller structure according to claim 6, wherein the at least one bent section is bent as a C shape or an S shape.

8. The roller structure according to claim 6, wherein the fixing portion comprises a third engaging element and the fixing recess comprises a fourth engaging element, and the third engaging element and the fourth engaging element are matched with each other, wherein when the fixing portion and the fixing recess are engaged with each other, the third engaging element and the fourth engaging element are engaged with each other.

9. The roller structure according to claim 8, wherein the third engaging element is a protrusion extended from an edge of the fixing portion and parted from the base, and the fourth engaging element is a slot opening disposed on a lateral wall of the fixing recess.

10. The roller structure according to claim 6, wherein the rotating wheel comprises a rotating shaft pivotally connected to the supporting portion and exposed from the corresponding accommodation seat.

11. The roller structure according to claim 10, wherein each accommodation seat comprises an installation window disposed on a bottom surface of the at least one frame body and configured to allow the corresponding roller unit to pass therethrough and be detachably disposed in the accommodation seat.

* * * * *